United States Patent [19]

Plant

[11] 4,023,681

[45] May 17, 1977

[54] KNOCK-DOWN WINE BOTTLE RACK

[76] Inventor: David N. Plant, 2789 25th St., San Francisco, Calif. 94110

[22] Filed: Jan. 8, 1976

[21] Appl. No.: 647,359

[52] U.S. Cl. ..... 211/74; 217/19; 312/257 R; 52/663

[51] Int. Cl.[2] ..... A47B 73/00

[58] Field of Search ..... 211/71, 74, 75; 217/18, 217/19, 22, 30–32, 65; 52/639, 691, 753 D, 753 F, 753 J, 758 F; 403/231, 402; 312/236, 259; D9/176–179, 181–183

[56] References Cited

UNITED STATES PATENTS

| | | | |
|---|---|---|---|
| 844,750 | 2/1907 | Rieschick | 151/37 |
| 1,681,048 | 8/1928 | Purcell | 151/33 |
| 1,806,639 | 5/1931 | Moltzan | 52/639 |
| 2,323,491 | 7/1943 | Schneeberger | 217/19 |
| 2,622,741 | 12/1952 | Bamert | 217/22 |
| 3,804,482 | 4/1974 | Smith | 312/236 |

FOREIGN PATENTS OR APPLICATIONS

| | | | |
|---|---|---|---|
| 1,245,776 | 10/1960 | France | 403/231 |
| 875,562 | 5/1953 | Germany | 211/74 |
| 1,249,387 | 10/1971 | United Kingdom | 211/74 |

*Primary Examiner*—Roy D. Frazier
*Assistant Examiner*—Terrell P. Lewis
*Attorney, Agent, or Firm*—Julian Caplan

[57] ABSTRACT

A rack to hold up to 116 standard wine bottles or similar contents consists of a square outer frame having two diagonal partitions in each direction, the partitions being slotted to interfit at their intersections. Four end pieces are provided, one for each end of each pair of partitions and the end pieces are bolted to the outer frame members. Each end piece consists of a rectangular base and a strip along opposed edges of the base which is nailed to the base. Each strip in cross-section has a back, a front parallel to and congruent with the back and two complementary sides consisting of right-angle grooves. Holes extended from back to front for the bolts which connect the sides to the outer frame. A T-nut or other fastener is preferably recessed into the front to engage the bolt. One edge of the base fits into one of the grooves in the sides of the strip and is nailed in place. An edge of a partition fits into the other groove in the strip.

3 Claims, 2 Drawing Figures

KNOCK-DOWN WINE BOTTLE RACK

This invention relates to a new and improved knock-down wine bottle rack.

A principal feature of the invention is the fact that prior to assembly it consists of four substantially identical frame members, four substantially identical diagonal partitions which fit within the frame members and four fabricated identical end pieces, all of which may be packaged in a corrugated paper container for storage and transportation. Thus there is considerable space saved which economizes on transportation costs. If desired, the rack may be disassembled when not in use.

Another feature of the invention is the fact that it is easily assembled using only a screwdriver and requires no special skill.

Another feature is the fact that the frame members, the partitions and the end pieces are interchangeable, making feasible large scale production.

Another advantage of the invention is the fact that the material is inexpensive, being preferably plywood, and the fabrication thereof is also inexpensive using standard woodworking machinery.

Another feature of the invention is the fact that when assembled it occupies a space 3 feet 3 × 3 feet 3 inches and less than 12 inches deep and yet over nine cases of wine may be stored in the rack provided, the partitions insuring thaat the bottles are not so compressed that it is difficult to remove one particular bottle from the rack. Although the device is intended for storing 116 conventional fifth-gallon wine bottles, it will also accommodate magnums, double magnums and also tenths of a gallon.

When assembled, the device fits in a relatively small area of floor space and wall space. The rack is strong and rigid and hence a plurality of racks may be stacked vertically or they may be assembled side by side.

Other objects of the present invention will become apparent upon reading the following specification and referring to the accompanying drawings in which similar characters of reference represent corresponding parts in each of the several views.

Figure 1:
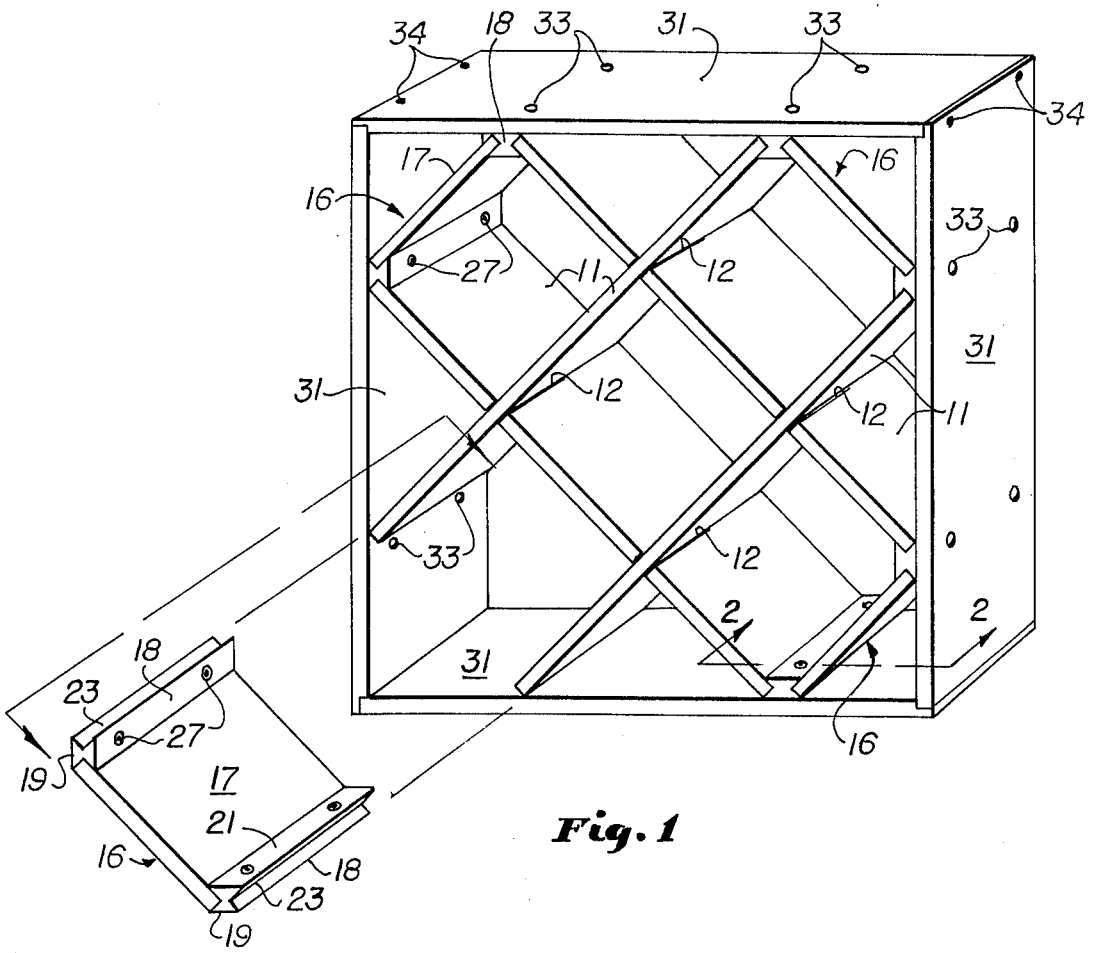
FIG. 1 is an exploded perspective view of a rack in accordance with the present invention, one of the end pieces for a pair of partitions being shown removed.
Figure 2:
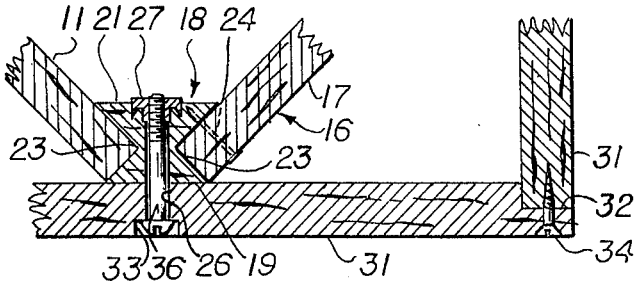
FIG. 2 is an enlarged fragmentary sectional view taken substantially along the ine 2—2 of FIG. 1.

The rack which is the subject of the present invention has preferably four partitions 11, one pair of such partitions being disposed at a 45° angle in one direction and another pair of partitions being disposed at an angle of 45° in the opposite direction. At the intersections of the partitions they interfit, each partition being slotted in a slot 12 which is of a width equal to the thickness of the partition and a length half the width of the partition 11. Thus the slots 12 interfit in egg-crate fashion. There is an end piece 16 at each end of each pair of partitions. Each end piece, as best shown at the lower left-hand corner of FIG. 1, consists of a base 17 which is a rectangular piece of wood or plywood having along each of two opposed edges a strip 18. The back 19 and front 21 of each strip 18 are parallel and congruent. On each side edge is a right angle groove 23. One of the grooves 23 receives one edge of base 17. As hereinafter appears, the opposite groove 23 receives an edge of one of the pair of partitions 11 which the end piece 16 interconnects. Nails 24 or staples or other fastening means fasten the base 17 to each of the two strips 18 which make up the end piece, and the strips 18 are preferably also glued to base 17. Optionally, end piece 16 may be a unitary member, molded of plastic. Extending from back 19 to front 21 is a hole 26 and recessed into front 21 is a T-nut 27 or other fastening means for a bolt 36 hereinafter defined.

There are four frame members 31, one end of each frame member preferably being formed with a rabbet 32. Counterbored holes 33 are located in frame members 31 opposite and in registry with the holes 26 in the final assembled position of the rack.

As a preliminary to assembly of the rack, the four partitions 11 are first assembled by interfitting the slots 12. Thereupon, the end pieces 16 are applied to each end of each of the pairs of partitions. The edges of the partitions rest on the floor during this operation, as do the edges of the end pieces 16.

To complete the assembly of the rack, after the partitions 11 and end pieces 16 have been installed as heretofore explained, one of the frame members 31 is placed in position abutting the front 19 of two edge strips 18 and bolts 36 are fitted into the holes 33 and holes 26 and fasteners 27. The installation of frame members 31 is repeated for each of the four sides, it being understood that the square edge of each frame member 31 is fitted into the rabbet 32 of the adjacent frame member 31. After the frame members 31 are all in place, the bolts 36 are given a final tightening. It would be seen that there is an end piece 16 at each corner of the completed rack which is firmly wedged in place, making a very rigid structure of frame members 31, end pieces 16 and partitions 11. To further rigidify the construction, screws 34 may be inserted in frame members 31 at the corners, passing through the rabbeted joint.

In the final rack, there are five large compartments which will hold 16 conventional wine bottles, four medium compartments (midway of the length of each frame member) which will hold six wine bottles and four corner compartments which will hold three conventional wine bottles making a total of 116 bottles.

What is claimed is:

1. A rack comprising four frame members forming a rectangular frame, a first pair of partitions within said frame parallel to each other and disposed in a first direction at a 45° angle to said frame members, a second pair of partitions within said frame parallel to each other, disposed in a second direction transverse to said first direction, first means interconnecting said partitions at their intersections, an end piece for each end of each pair of partitions disposed across a corner of said frame, and second means securing opposite ends of said end piece to each of two said frame members, each said end piece comprising a base transverse to the direction of the partitions to which said end piece is connected and edge members along opposite edges of said base, one side of said edge member opposite said base being formed with a groove at a right angle to a plane perpendicular to said partitions and to said base, said groove receiving one corner of one of said partitions, said second means passing through said edge member and securing said edge member to one of said frame members, said second side of said edge member opposite said one side being formed with a second groove similar to said first-mentioned groove receiving one corner of said base, the length of each said partition being at least three times the length of said base.

2. A rack according to claim 1 in which said edge member originally is separate from said base and is secured to said base by second fastening means.

3. A rack according to claim 1 in which said second means comprises a bolt having a head recessed into the outside surface of said frame member and a shank passing through said frame member and through said edge member and a nut recessed into the inside surface of said edge member.

* * * * *